United States Patent [19]

Klasing

[11] 3,988,944

[45] Nov. 2, 1976

[54] QUICK-RELEASE MECHANISM FOR A RAILWAY CAR HAND BRAKE OF THE NON-SPIN TYPE

[75] Inventor: Wayne G. Klasing, New Lenox, Ill.

[73] Assignee: Klasing Hand Brake Co., Joliet, Ill.

[22] Filed: Oct. 1, 1975

[21] Appl. No.: 618,503

Related U.S. Application Data

[63] Continuation of Ser. No. 456,638, April 1, 1974, abandoned.

[52] U.S. Cl. ..... 74/505

[51] Int. Cl.[2] ..... G05G 1/08

[58] Field of Search ..... 192/16; 74/505, 506

[56] References Cited

UNITED STATES PATENTS

| | | | |
|---|---|---|---|
| 3,173,305 | 3/1965 | Mersereau | 74/505 |
| 3,176,539 | 4/1965 | Mersereau | 74/505 |
| 3,425,294 | 2/1969 | Klasing | 74/505 |
| 3,453,902 | 7/1969 | La Belle | 74/505 |
| 3,750,488 | 8/1973 | McClure | 74/506 X |

*Primary Examiner*—Samuel Scott
*Assistant Examiner*—Lance W. Chandler
*Attorney, Agent, or Firm*—Norman H. Gerlach

[57] ABSTRACT

A hand brake assembly for a railway car in which a self-energizing friction clutch which is associated with the hand wheel shaft permits a graduated release of the car brakes and prevents spinning of the hand wheel. A manually-operable quick release of the car brakes is made possible by the provision of a second manually-shiftable jaw clutch, the components of which are spring-biased to their position of clutch engagement by a positive acting compression spring which is interposed between such components, such second jaw clutch being disposed in the power train between the hand wheel shaft and the chain winding drum, and the two clutches thus being disposed in series relationship.

1 Claim, 10 Drawing Figures

FIG. 6
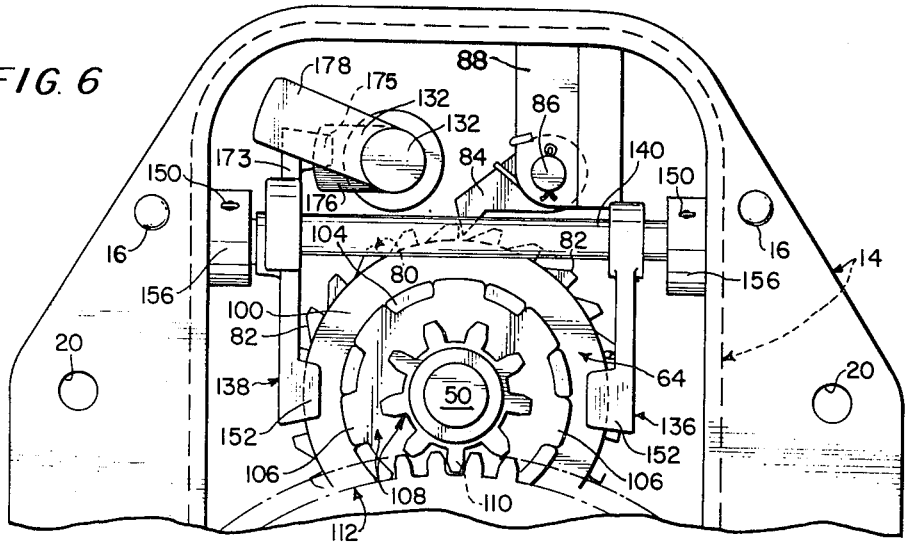
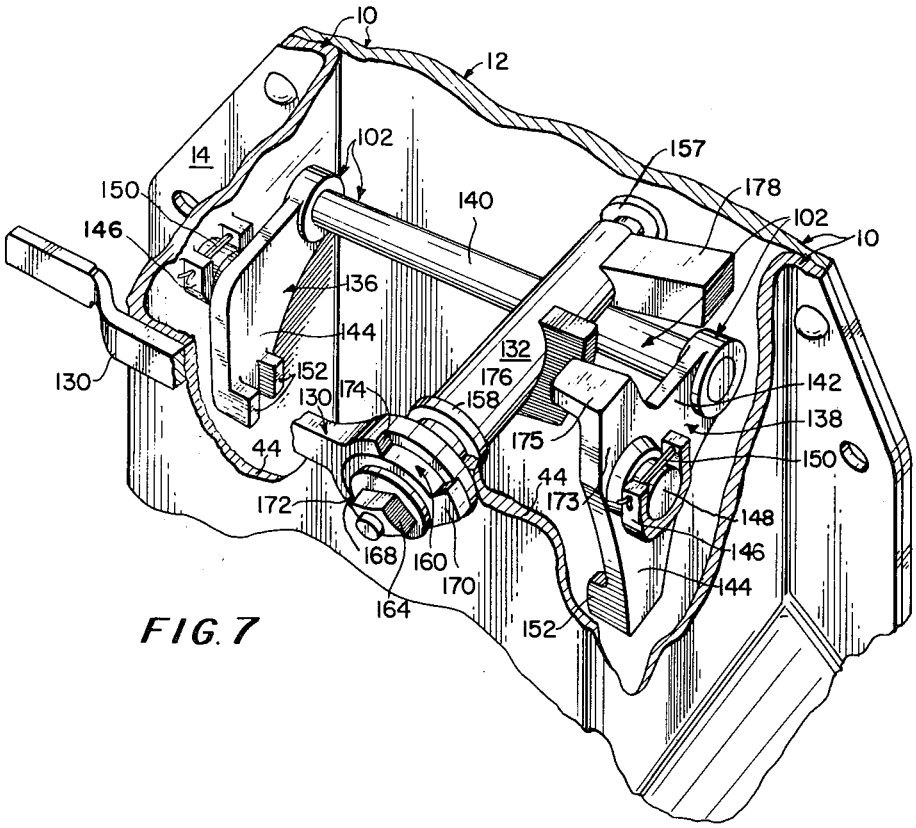
FIG. 7

QUICK-RELEASE MECHANISM FOR A RAILWAY CAR HAND BRAKE OF THE NON-SPIN TYPE

This application is a continuation of application Ser. No. 456,638, filed on Apr. 1, 1974 now abandoned and entitled "QUICK-RELEASE MECHANISM FOR A RAILWAY CAR HAND BRAKE OF THE NON-SPIN TYPE."

The present invention relates to a non-spin hand brake assembly for a railway car and has particular reference to a quick-release mechanism which obviates the necessity of reversely rotating the usual brake-applying hand wheel throughout the several complete revolutions that are ordinarily required of it where a conventional non-spin hand brake assembly is concerned.

The quick-release mechanism of the present invention is similar in many respects to but is an improvement on the quick-release mechhanism which forms the subject matter of U.S. Pat. No. 3,425,294, granted to me on Feb. 4, 1969, and entitled "NON-SPIN HAND BRAKE ASSEMBLY WITH QUICK-RELEASE MECHANISM THEREFOR."

There has long been in use a class of railway car hand brakes which are commonly referred to as "non-spin" brakes and in which provision is made for a graduated release of the braking effect when the associated operating hand wheels are turned in a counterclockwise direction throughout small increments of rotational movement and then released. A hand brake of this general type is invariably pawl and retchet operated and embodies a non-spin friction clutch mechanism which is effective between the hand wheel shaft and the winding drum on which the brake-operating chain is wound, the clutch remaining fully engaged or effective during turning movement of the hand wheel shaft in a brake-applying (clockwise) direction but become partially disengaged during the application of small increments of turning movement of the shaft in a brake-releasing (counterclockwise) direction, and then becoming fully engaged again when the hand wheel is released so that the pawl assimilates the tension in the brake-operating chain and the hand wheel is prevented from spinning.

More recently, a non-spin hand brake of the aforementioned type has been provided with quick-release features wherein dual release functions are possible, namely, the conventional gradual non-spin release function and an additional quick-release function by means of which the gradual release function is disabled under the control of a quick-release lever which, when operated, disengages a second or quick-release clutch mechanism which is effectively disposed in series with the friction clutch mechanism, thereby allowing the winding drum to spin out to completion without disturbing the non-spin friction clutch which, being engaged, maintains the hand wheel against reverse rotation. Obviously, this second clutch must normally be maintained engaged at all times during operation of the hand wheel for either brake application or brake release and, toward this end, it is spring-biased to its engaged condition. Only when the quick-release lever is operated will such second quick-release clutch become disengaged and, accordingly, the quick-release lever is caused to act on a moving or shiftable member of the second clutch by means of a pivoted shifting fork mechanism which actually performs the shifting operation against the action of the spring-biasing means. Such a quick-release mechanism is shown and described in aforementioned U.S. Pat. No. 3,425,294.

In the non-spin hand brake assembly of such patent, the spring-biasing means for maintaining the second clutch engaged except when the quick-release lever is actuated is actuated is in the form of a coiled torsion spring which, by reason of its tightly coiled condition, exerts torque on the shifting fork in a direction tending to move the shiftable member of the quick-release clutch to its position of clutch engagement. It has been found that the use of a torsion spring for this purpose is less positive than is desirable, first, because torsion springs, unless unduly massive, do not exert the necessary output torque to be effective under all conditions of use, and secondly, because the torque which is applied to the shifting fork is not transmitted thereto at its most effective region so that the total output thrust which is exerted upon the shiftable member of the second or quick-release clutch does not embody the full capabilities of the torsion spring.

The improvement which the quick-release mechanism of the present invention offers over the quick-release mechanism of my aforementioned U.S. Pat. No. 3,425,294 resides in the elimination of the torsion spring which only indirectly biases the shiftable member of the second quick-release clutch and the use instead of a helical compression spring which is interposed between an element of the first non-spin friction and the shiftable member of the second or non-spin clutch and functions at all times yieldingly to urge such shiftable member to its position of clutch engagement. As will become more readily apparent when the nature of the invention is better understood, the use of a helical compression spring instead of a torsion spring is conducive toward the application of greater spring force to the movable member of the quick-release clutch by reason of the fact that, given the same clutch and shift yoke structure, space limitations are in favor of the compression spring and, therefore, a spring of greater diameter and of heavier spring stock is made possible. Added to this is the fact that a helical compression spring, as used in connection with the present invention, is possessed of greater spreading action when interposed between two elements than is a torsion spring which exerts its force partly in torsion and partly in flexion as used in connection with the quick-release clutch structure of the hand brake assembly of my aforementioned U.S. Pat. No. 3,425,294.

The primary object of the present invention is, therefore, to provide a non-spin hand brake assembly which is an improvement on and is more efficient than that of my U.S. Pat. No. 3,425,294.

Other objects of the invention will be apparent from a consideration of the following detailed description.

The invention consists in the several novel features which are hereinafter set forth and are more particularly defined by claims at the conclusion hereof.

In the accompanying five sheets of drawings forming a part of this specification, one illustrative embodiment of the invention has been shown.

In these drawings:

FIG. 6 is a fragmentary rear view of the hand brake assembly with the base member removed;

FIG. 7 is a fragmentary perspective view of the hand brake assembly showing only such parts as are associated with the quick-release mechanism, such parts being shown in the positions which they assume when the brake is applied;

Figure 1:
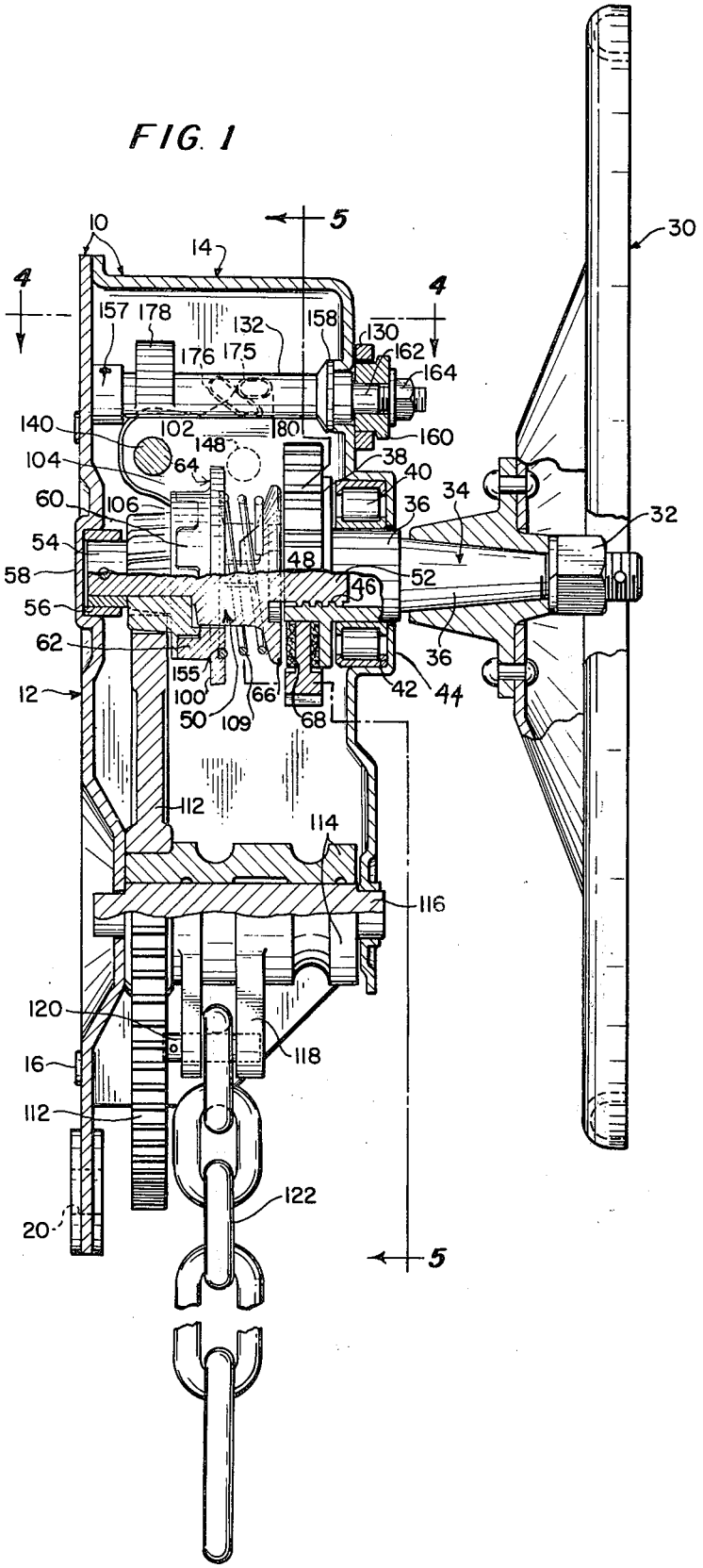
FIG. 1 is a vertical section taken substantially centrally, longitudinally and vertically through a hand brake assembly embodying a quick-release mechanism in which the parts thereof are spring-biased according to the present invention to the position which they assume when the mechanism is inoperative and the assembly as a whole is conditioned for brake application.

Referring now to the drawings in detail and in particular to FIG. 1, the quick-release mechanism to which the present invention is applied is shown as being operatively embodied in a non-spin gradual release type of hand brake assembly of the general type which is shown and described in aformentioned U.S. Pat. No. 3,425,294, such assembly involving in its general organization a two-piece housing 10 including a rear base member 12, and a front cover member 14. These members are adapted to be secured together by rivets 16 or other fastening devices. The base member 12 of the housing 10 is in the form of a generally flat plate while the cover member 14 is of cup-shape configuration and embodies with an outwardly extending flange 18 through which the rivets 16 extend. Bolt holes 20 are provided in the corner portions of the base member 12 in order that the entire hand brake assembly may be bolted to an end wall of a railway car in the usual manner.

Figures 8, 9, 10:
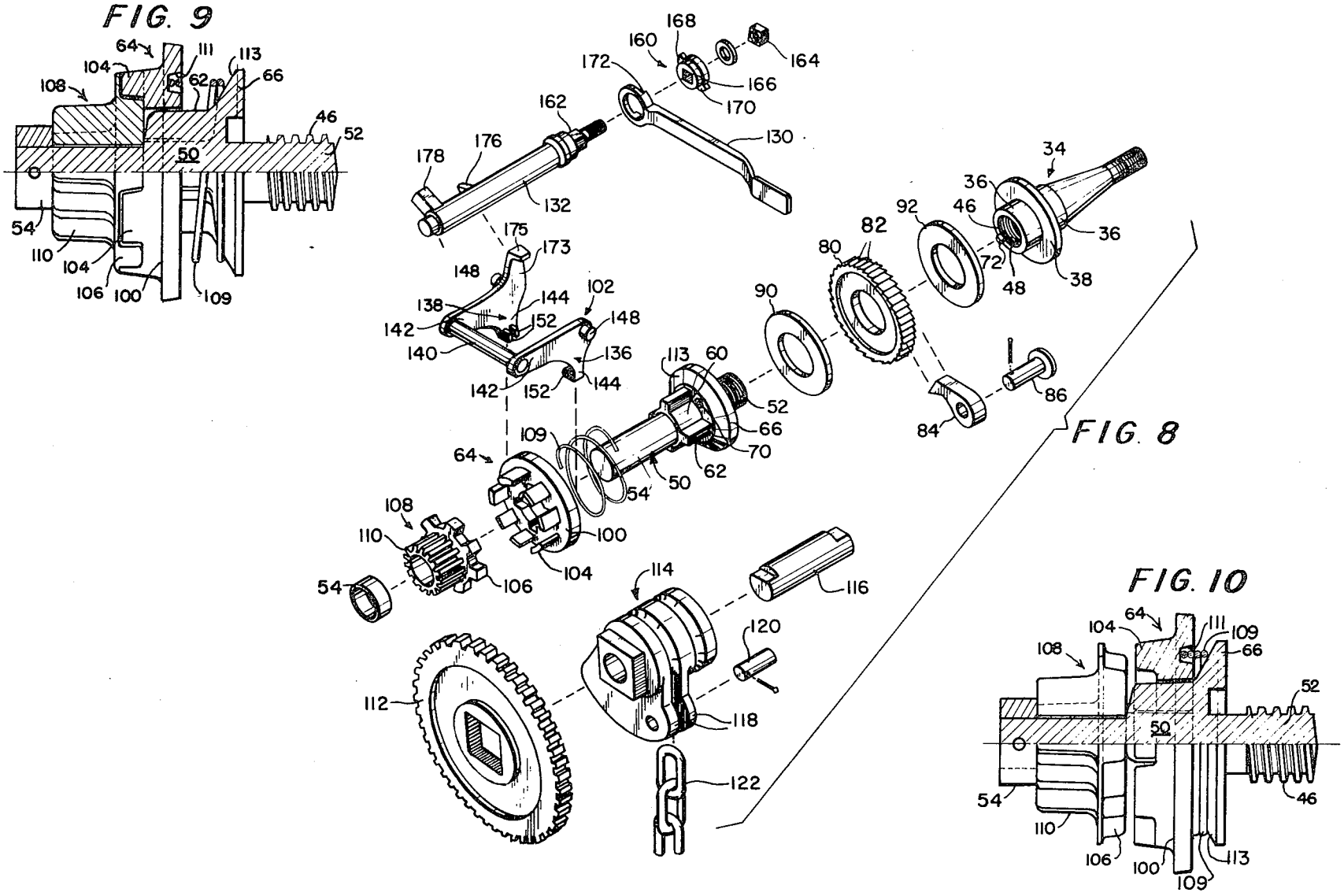
FIG. 8 is an exploded perspective view illustrating the positional relationship of all of the relatively movable parts of the hand assembly, the brake housing being omitted in the interests of clarity.
FIG. 9 is a side elevational view, partly in section, of a spring-biased clutch arrangement which is employed in connection with the invention, the clutch arrangement being shown in its position of clutch engagement.
FIG. 10 is a side elevational view similar to FIG. 9 but showing the clutch arrangement in its position of clutch disengagement.

A conventional hand wheel 30 is affixed by means of a nut 32 to the front end of a horizontally extending, rotatable shaft 34. The shaft 34 extends through an opening in the cover member 14 and is provided on the rear portion thereof with an enlarged hub 36 from the rear end of which there extends a radial circular clutch reaction flange 38. The hub 36 is journalled in an anti-friction roller bearing assembly 40 which is nested within a recess 42 on the inside of the front wall 44 of the cover member 14. The rear end of the hub 36 is formed with a relatively deep central cylindrical socket 46 (see FIGS. 2 and 8) which has a threaded section 48 near its rim portion.

Figure 5:
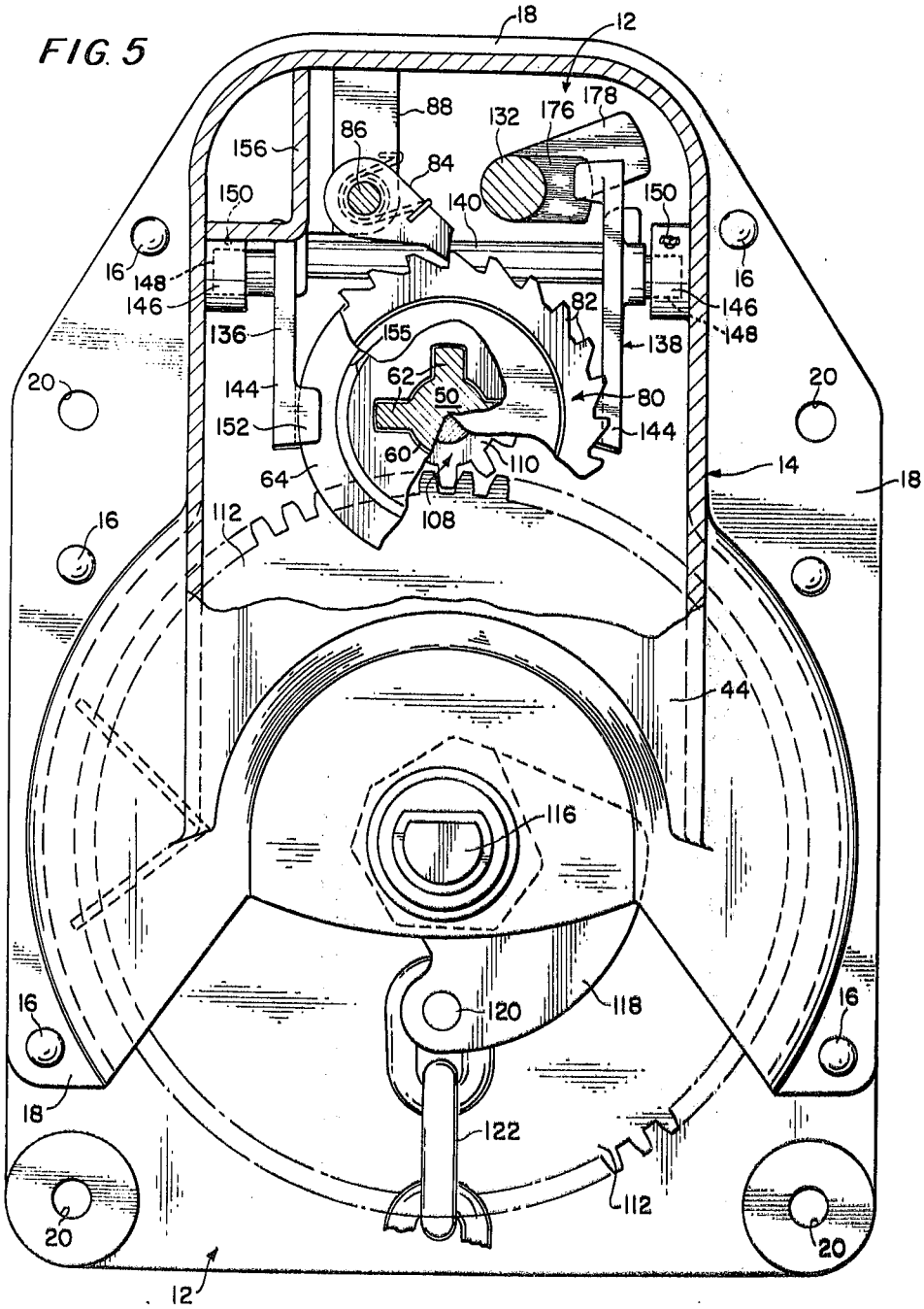
FIG. 5 is a vertical sectional view taken on the line 5—5 of FIG. 1.

A horizontal axially shiftable clutch shaft 50 which is disposed within the housing 10 in coaxial relationship with respect to the hand wheel shaft 34 is provided at its front end with a reduced threaded pilot stem 52 which is threadedly received in the threaded section 48 of the socket 46. The rear end region of the clutch shaft 50 is cylindrical and constitutes a bearing section 54 which is rotatably supported in a bushing 56. The latter is fixedly mounted in a recess 58 in the upper portion of the base member 12. The enlarged medial region 60 of the clutch shaft 50 constitutes a slide section which is provided with a series of four splines 62 (see FIG. 5) which cooperate with a clutch collar 64 in a manner that will be made clear subsequently.

Immediately forwardly of the enlarged medial region 60 of the clutch shaft 50 there is provided a circular radial flange 66 which is integrally formed on the clutch shaft and is provided with a forwardly facing clutch face 68. A stop pin 70 is threadedly received in an internally-threaded socket in the flange 66, cooperates with an abutment shoulder 72 on the rim portion of the socket 46 in the rear end of the hub 36, and limits the extent of relative turning movement between of the two shafts 34 and 50.

The hub 36 of the hand wheel shaft 34 serves rotatably to support a ratchet wheel 80 having formed thereon teeth 82 which are designed for engagement with a pivoted spring-pressed pawl 84 (see FIGS. 5 and 6), such pawl being mounted on a horizontal pin 86. Such pin is supported by a lug or boss-like enlargement 88 on the cover member 14.

A friction disk 90 (see FIGS. 2 and 3) is interposed between the forwardly facing clutch face 68 of the radial flange 66 and the rear face of the ratchet wheel 80, while a similar friction disk 92 is interposed between the rear face 94 of the reaction flange 38 and the front face of the ratchet wheel 89. The two disks and the ratchet wheel are thus capable of limited axial movement on the hub 36 so that, when the hand wheel 30 is manually rotated in a clockwise direction as viewed from the right-hand side of FIG. 1, the two friction disks and the interposed ratchet wheel 80 will be compressed as a unit between the clutch face 68 and the rear face 94 of the reaction flange 38 thus resulting in the entire clutch assembly including the hand wheel shaft 34 and the clutch shaft 50 becoming locked up and consequently rotating bodily as a unit during application of the hand brake.

Figure 2:
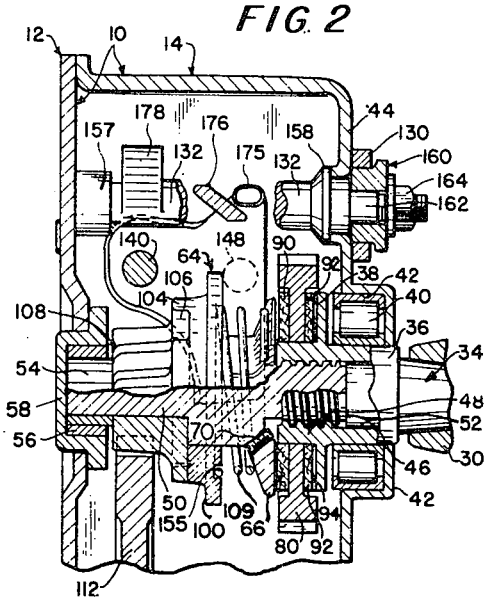
FIG. 2 is a fragmentary sectional view of a porition of the structure shown in FIG. 1 and in the vicinity of the quick-release mechanism, certain parts being broken away in the interests of clarity.

As best illustrated in FIGS. 2. 3, 5 and 8 of the drawings, the clutch collar 64 is capable of limited sliding movement on the enlarged region 60 of the clutch shaft 50. Such clutch collar is formed with a radial flange 100 by means of which it may be shifted bodily along the axis of the clutch shaft 50 under the control of a pivoted yoke assembly 102. The clutch collar 64 is also formed with an annular series of rearwardly projecting clutch teeth 104 (see also FIGS. 3, 9 and 10) which are designed for cooperation with a series of mating clutch teeth 106 on a combined pinion and clutch wheel 108 on the rear end region of the clutch shaft 50. Normally, the clutch collar 64 and the clutch wheel 108 are maintained in clutching engagement with each other by means of a helical compression spring 109 which surrounds the clutch shaft 50 and is interposed between the circular radial flange 66 on such shaft and the radial flange 100 on the clutch collar 64. The rear end of the spring 109 seats within an annular groove 111 which is formed in the forward face of the clutch collar 64 while the front end of the spring bears against a frusto-conical seating surface 113 (see particularly FIGS. 8, 9 and 10) on the rear side of the radial flange 66. The spring 109 is thus centered about the clutch shaft in coaxial relationship.

The clutch wheel 108 is provided with a pinion section 110 which meshes with a main winding gear 112 of relatively large diameter, such gear being mounted on and rotatable with a drum member 114 which, in turn, is mounted on a horizontal drum shaft 116 that is supported at its ends in the lower regions of the base member 12 and the cover member 14 of the housing. The drum member 114 is provided with an integral radially extending bifurcated crank arm 118 which carries at its distal end a horizontal crank pin 120. The latter passes through the uppermost link of a tensioning chain 122. Such chain leads to the brake shoe mechanism (not shown) with which the hand brake assembly is associated.

From the above description, it will be apparent that when the clutch collar 64 is maintained in its normally clutched engagement with the combined pinion and clutch wheel 108, the hand brake functions in the manner of a conventional non-spin brake mechanism whereby tension in the chain 122 may be released in small increments without the application of spinning torque to the hand wheel 30. Briefly, when it is desired to apply the car brakes, the hand wheel 30 is rotated manually in a clockwise direction as viewed from the right-hand side of FIG. 1. Inasmuch as the chain 122 is at that time unwound from the drum member 114 and, therefore, is slack, the clutch assembly, including the ratchet wheel 80 and the friction clutch disks 90 and 92, is disengaged and the clutch shaft 50 is backed off, so to speak, on the internally-threaded section 48 of the socket in the rear end of the hand wheel shaft 34 so that the ratchet wheel is unclutched from the shaft 34. As the hand wheel and shaft are gradually turned in such clockwise direction, the clutch shaft is caused to move forwardly due to the fact that the rotational movement of the pinion section 110 is restricted by the inertia of the spur gear 112, the drum member 114 and the chain 122, as well as by the gravitational and tensional drag on the chain by the railway car brake devices. Upon such threaded movement of the clutch shaft 50, the radial flange 66 will cooperate with the opposing radial flange 38 on the hand wheel shaft 34 to lock up the entire clutch mechanism as previously set forth so that the shaft 34 will rotate in unison with the clutch shaft 50 and establish a rigid power train leading to the chain 122. As the drum 114 continues to rotate, the crank pin 120 will move upwardly and cause the chain to commence winding upon the drum thus gradually applying the car brakes.

At such time as the brakes become set, the countertorque on the pinion section 110 of the clutch wheel 108 has a tendency to impart reverse rotation to such pinion section. Such a tendency is effective to thread the forward end of the clutch shaft 50 into the socket 46 in the hand wheel shaft 34 and maintain the clutch assembly locked up so that the pawl 86 will be effective against the entire clutch assembly and not merely against the ratchet wheel 80. Consequently, the brake will not be released even though the hand wheel 30 is released by the operator.

In order to effect gradual release of the brake, the hand wheel 30 will be turned in a counterclockwise direction as viewed from the right-hand side of FIG. 1 throughout any desired small increment of motion. Upon initial movement of the hand wheel 30, the hand wheel shaft 34 and the clutch shaft 50 will turn in unison and as soon as the influence of the pawl 86 acting on the ratchet wheel 82 terminates movement of the latter, continued counterclockwise movement of the hand wheel 30 will cause the mating threads on the shafts 34 and 50 to be turned relatively to each other and back off the clutch shaft so as to relieve the pressure of the friction disks 90 and 92, thus partially releasing the clutch assembly. Such partial release will take place only during such time as counterclockwise torque is applied to the hand wheel and, immediately upon cessation of such torque, the countertorque which is applied through the power train leading from the chain 122 to the clutch shaft 50 will again lock the clutch parts against relative rotation.

Referring now to FIGS. 7 to 10, inclusive, the control mechanism for shifting the clutch collar 64 between its position of clutched engagement with the clutch wheel 108 and its position of release embodies a lever 130 which operates through a horizontal cam shaft 132 to control the rocking movements of the previously mentioned pivoted yoke assembly 102. The latter, in turn, operates in the manner of a dual shifting fork to engage the radial flange 100 of the clutch collar 64 and shift the same bodily into and out of clutching engagement with the combined pinion and clutch wheel 108. The cam shaft 132 is disposed in the upper portion of the housing 10 and it extends in parallel relation with the shafts 34 and 50 and has its ends journalled on the base and cover members of the housing. The front end of the cam shaft 132 extends through the front wall 44 of the cover member 14 of the housing 10.

The pivoted yoke assembly 102 is comprised of two fork members 136 and 138 which are rigidly connected together by a connector bar 140. Each fork member, in effect, constitutes a bell crank lever having a horizontal long arm 142 and a depending short arm 144. The fork members are pivoted to the opposite side walls of the cover member 14 of the housing 10 near the junctures between the long arms 142 and the short arms 144, the connection being in the form of cradle supports 146 which receive trunnions 148 and maintain them captured by means of cotter pins 150. The bar 140 extends between and has its ends fixed to the outer ends of the long arms 144. The lower end of each short arm 144 carries lugs 152 which project inwardly and straddle the radial flange 100 of the clutch collar 64, such lugs thus constituting shift forks by means of which longitudinal shifting motion may be applied to the clutch collar 64 during rocking movement of the pivoted yoke assembly 102.

The cam shaft 132 is disposed above the level of the trunnions 148 and it cooperates with the fork member 138 to apply rocking movement to the entire yoke assembly 102. The rear end of the cam shaft 132 is mounted for rocking movement in a circular boss 157 on the wall 44 of the housing section 12, while the front end of the cam shaft 132 projects through the front wall 44 of the cover member 14 as shown in FIGS. 1, 2, 3 and 7, and is prevented from axial shifting by means of an intergral radial flange 158 adjacent to the inside of the front wall and an abutment sleeve 160, the latter being adjacent to the outside of said front wall. The abutment sleeve 160 is disposed on a squared portion 162 at the front end of the cam shaft 132 and is held on such shaft by a nut 164. The lever 130 has its proximate end rotatably mounted on a cylindrical portion 166 (see FIG. 8) of the abutment sleeve 160 and a lost-motion connection between the sleeve and lever enables the lever to swing in idle fashion and without function between two extreme positions as determined by the provision of a pair of spaced stop lugs 168 and 170 on the abutment sleeve 160 and a pair of spaced abutment shoulders 172 and 174 on the inner end of the lever. During the idle motion of the lever 130, rocking movement of the cam shaft 132 is not effected. However, when the abutment shoulder 172 on the lever engages the stop lugs 168 on the abutment sleeve 160, further depression of the lever will cause counterclockwise rocking movement of the cam shaft. Similarly, when the shoulder 174 on the lever 130 engages the stop lug 170 on the sleeve 160, further swinging movement of the lever in a clockwise direction will effect clockwise rocking movement of the cam shaft 132.

The fork member 138 of the yoke assembly 134 is provided with an upstanding arm 173 (see FIGS. 7 and 8) from which there projects laterally a lug 175 which is disposed in the vicinity of the cam shaft 172. Such lug is designed for cooperation with a spiral lift cam 175 which is formed on the shaft 132 near the rear end of the latter. A second or hold-down cam 178 on the cam shaft 132 cooperates with the distal end of the long arm 142 of the fork member 138. The lift cam 176 normally underlies the lug 175 and is so designed that, when the lever 130 is horizontal as shown in FIG. 7 with the stop shoulder 172 in engagement with the stop lug 168, the lift cam 176 bears upwardly against the lug 175 and the gravitational weight of the lever assists the action of the spring 109 in maintaining the pivoted yoke 102 in its position of clutch engagement between the clutch collar 64 and the clutch wheel 108. At this time, the hold-down cam 178 is out of contact with the outer end of the long arm 142 of the fork member 138 as shown in FIGS. 6 and 7 of the drawings. When the lever 130 is in its vertical position with the abutment shoulder 174 in engagement with the stop lug 170, the spiral lift cam 176 is out of contact with the lug 175, thus affording clearance for swinging movement of the entire yoke assembly 102 against the action of the spring 109 to a position wherein the clutch collar 64 and the clutch wheel 108 are out of meshing engagement. This movement of the yoke assembly 102 is initiated by the hold-down cam 178 which, during swinging of the lever 130, engages the end of the long arm 142 and depresses such arm, thus swinging the short arm 144 in a forward direction and causing the circular radial flange 100 of the clutch collar 64 which is confined between the two lugs 152 to be shifted forwardly thereby to shift the clutch collar out of meshing engagement with the clutch wheel 108.

Figure 3:
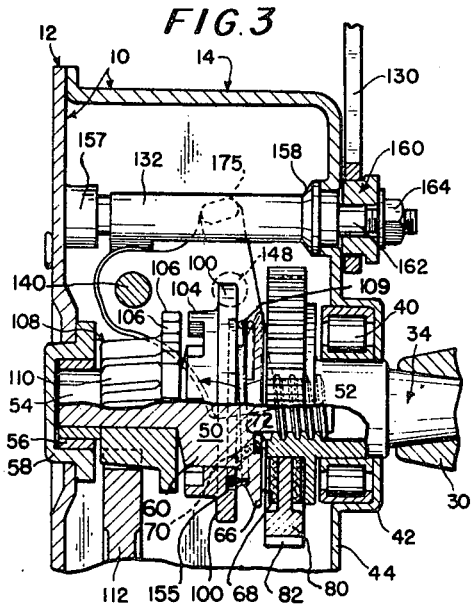
FIG. 3 is a fragmentary sectional view similar to FIG. 2 but showing the parts in the position which they assume when they are shifted against the action of the spring-biasing means to a position of brake release.
Figure 4:
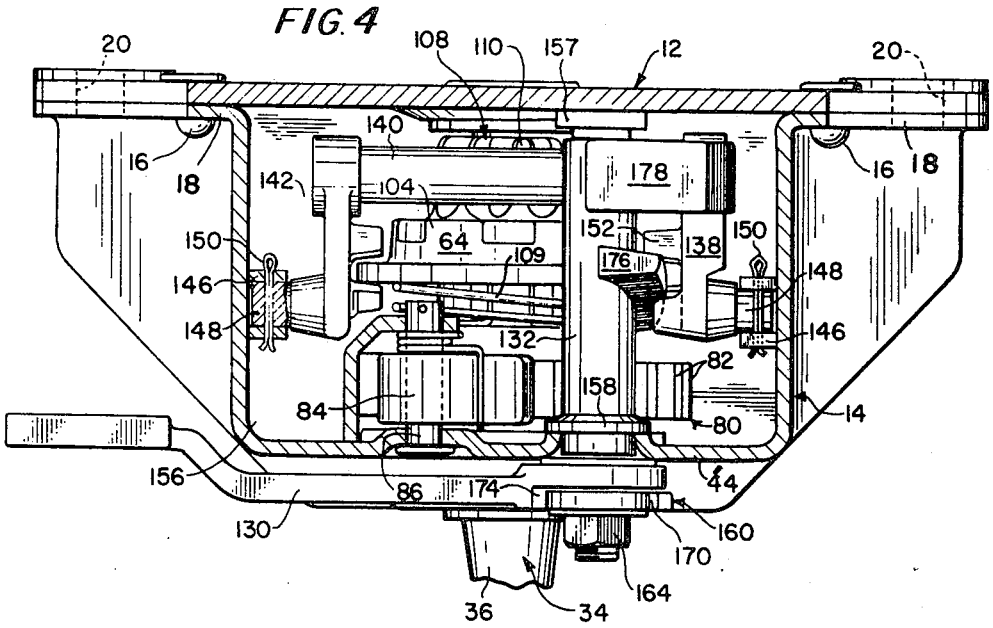
FIG. 4 is a horizontal sectional view taken on the line 4—4 of FIG. 1.

In the operation of the hand brake assembly, the control lever 130 will normally be maintained in the horizontal position in which it is shown in FIGS. 1, 2, 4 and 7 so that its gravitational weight will assist the helical compression spring 109 in holding the clutch parts 64 and 108 in mesh. As previously stated, with these two clutch parts thus meshing with each other, normal hand wheel operation, either for tightening or gradually releasing the railway car brakes, is made possible. When it is desired to effect a quick release of the tension in the chain 122, it is merely necessary for the operator to shift the control lever 130 from its horizontal position to its vertical position as shown in FIG. 3. Such movement of the lever will be ineffective during a major portion of the angular sweep thereof and, during this time, the gap between the stop shoulder 174 and the stop lug 170 will progressively become closed. As soon as the stop shoulder 174 engages the stop lug 170 angular turning movement of the abutment sleeve 160 will be initiated with a consequent rotation of the cam shaft 132 in a direction to cause cooperation between this cam shaft and the yoke assembly 102 and thus swing the two short arms 144 of the fork members 136 and 138 forwardly to shift the clutch collar 64 out of meshing engagement with the combined pinion and clutch wheel 108 against the action of the helical compression spring 109. Since the clutch wheel 108 is freely rotatable upon the rear end region 54 of the clutch shaft 50, release of the clutch wheel by the clutch collar 64 enables the tension in the chain 122 to be dissipated through the drum member 114 and the spur gear 112 to the pinion section 110 of the clutch wheel 108. The clutch wheel will thus spin idly until such time as all of the tension in the chain has been relieved. Meanwhile, the hand wheel 30 will remain stationary since the power train leading thereto from the chain has been broken by the existence of the freely rotatable clutch wheel 108.

It is to be noted at this point that with the control lever 130 in its vertical position of brake release, manipulation of the hand wheel 30 in either direction will be without function since no motion can be transmitted from the hand wheel shaft 34 through the pinion section 110 of the clutch wheel 108 due to the fact that such clutch wheel 108 and the clutch collar 64 are not in meshing engagement with each other and the power train leading from the hand wheel 30 to the chain is thus discontinued.

The invention is not to be limited to the exact arrangement of parts shown in the accompanying drawings or described in this specification as various changes in the details of construction may be resorted to without departing from the spirit or scope of the invention. Therefore, only insofar as the invention is particularly pointed out in the accompanying claim is the same to be limited.

Having thus described the invention what I claim as new and desire to secure by letters patent is:

1. In a hand brake assembly of the type which embodies a rotary chain-winding drum having a main winding gear thereon, an axially-shiftable clutch shaft having a cylindrical bearing section, a splined slide section, and a radial flange thereon, said radial flange being formed with a generally frusto-conical rear face, a pinion mounted directly on said bearing section and rotatable freely thereon, said pinion meshing with said winding gear, a clutch collar mounted on and splined to said splined section, slidable directly into and out of clutching engagement with the pinion, and rotatable in unison with the clutch shaft, said clutch collar being formed with an annular seating groove in the peripheral region of the forward face thereof, an axially fixed hand wheel shaft coaxial with said clutch shaft, said hand wheel shaft being formed with a threaded socket therein, the adjacent end of the clutch shaft being threadedly received in said socket for limited axial shifting movement of the clutch shaft in opposite directions upon relative turning movement between the two shafts in opposite directions respectively, a clutch face on said clutch shaft, an opposing clutch face on said hand wheel shaft, a ratchet wheel freely rotatable on said hand wheel shaft and disposed between said clutch faces, a pawl cooperating with said ratchet wheel for preventing rotation of the latter in one direction, said clutch shaft being movable between a position of clutch engagement wherein said ratchet wheel is clamped between said clutch faces and a position of clutch release wherein said ratchet wheel is released by said clutch faces, the extend of threaded engagement between said threaded socket in the hand wheel shaft and the threaded end of the clutch shaft being such that upon initial turning movement of the hand wheel shaft in a drum-winding direction the clutch shaft will be shifted to its position of clutch engagement, after which continued rotation of the hand wheel shaft in said direction will effect continued rotation of the clutch shaft in the same direction, and that upon turning movement of the hand wheel shaft in the reverse direction the clutch faces will release said ratchet wheel and effect a graduated reverse rotation of the clutch shaft in a drum-unwinding direction, and a shift fork mounted for swinging movement in a plane parallel to the axis of said clutch collar and engageable with the collar for moving the same positively in opposite directions, the improvement which comprises a helical compression spring encircling said splined section of the clutch shaft and interposed between said clutch collar and the radial flange on the clutch shaft with its rear end seated within an annular seating groove which is formed in the forward face of the clutch collar and its forward end seated upon and thus centered by said generally frustoconical rear face of the radial flange on said clutch shaft, said spring yieldingly biasing said clutch collar into meshing engagement with said pinion, a cam shaft in the vicinity of said shift fork, a first cam on said cam shaft and capable during rotation of the latter in one direction of engaging and swinging the shift fork in a direction to effect clutch collar and pinion engagement, a second cam on said cam shaft and effective during rotation of the cam shaft in the opposite direction to engage and swing the shaft fork in a direction to effect clutch collar and pinion disengagement, and a lever on said cam shaft for selectively rotating the latter in opposite directions, said lever projecting radially outwardly of the cam shaft and being movable between a substantially vertical and a substantially horizontal position, said lever when forcibly moved toward its horizontal position serving positively to force the clutch collar into meshing engagement with said pinion.

* * * * *